US010222093B2

(12) United States Patent
Massimino

(10) Patent No.: US 10,222,093 B2
(45) Date of Patent: Mar. 5, 2019

(54) FLOW CONTROL DEVICES FOR CONVECTOR HEATERS

(71) Applicant: CHORE-TIME EUROPE B.V., NK Panningen (NL)

(72) Inventor: Gianpiero Massimino, Savigliano (IT)

(73) Assignee: Chore-Time Europe B.V., NK Panningen (NL)

( * ) Notice: Subject to any disclaimer, the term of this patent is extended or adjusted under 35 U.S.C. 154(b) by 141 days.

(21) Appl. No.: 15/525,961

(22) PCT Filed: Nov. 11, 2015

(86) PCT No.: PCT/IB2015/058708
§ 371 (c)(1),
(2) Date: May 11, 2017

(87) PCT Pub. No.: WO2016/075632
PCT Pub. Date: May 19, 2016

(65) Prior Publication Data

US 2017/0321929 A1 Nov. 9, 2017

(30) Foreign Application Priority Data

Nov. 11, 2014 (IT) ..... TO2014A0939

(51) Int. Cl.
*F24F 13/12* (2006.01)
*F24H 3/02* (2006.01)
(Continued)

(52) U.S. Cl.
CPC ..... *F24H 3/022* (2013.01); *F24F 11/0001* (2013.01); *F24F 13/12* (2013.01);
(Continued)

(58) Field of Classification Search
CPC ..... Y10T 137/86807; Y10T 137/86799; Y10T 137/86815; F24H 9/0063; F24H 9/0073; F24F 13/12
See application file for complete search history.

(56) References Cited

U.S. PATENT DOCUMENTS 832,247 A * 10/1906 Edwards ..... F24F 7/02 454/354
3,994,315 A * 11/1976 Muller ..... C21B 9/12 137/601.01
(Continued)

FOREIGN PATENT DOCUMENTS

DE 102006035336 A1 5/2007
EP 1526312 A1 4/2005
(Continued)

*Primary Examiner* — Matthew W Jellett
(74) *Attorney, Agent, or Firm* — Clark Hill PLC

(57) ABSTRACT

Flow control devices for convector heaters are provided. Such devices may include a casing in the shape of a cylindrical tube having in a first portion thereof, facing in a mounted condition towards the intake conduit of a convector heater, a plurality of first openings and in a second portion thereof, facing in the mounted condition towards the opposite side of the intake conduit, a plurality of second openings, the casing being arranged to be mounted onto the ceiling (S) in such a manner that the first and second openings allow the inside of the casing to be placed into communication with a first space (A1) beneath the ceiling (S) and with a second space (A2) above the ceiling (S), respectively; a closure member in the shape of a cylindrical tube which is mounted within the casing and is axially slidable relative to the latter between a first position, in which it leaves the first openings open and closes the second openings, and a second position, in which it closes the first openings and leaves the second openings open; and actuation elements for controlling the axial sliding movement of
(Continued)

the closure member relative to the casing between the first and second position.

4 Claims, 3 Drawing Sheets

(51) Int. Cl.
*F24F 11/00* (2018.01)
*F24H 9/00* (2006.01)
*F24H 9/06* (2006.01)

(52) U.S. Cl.
CPC ..... *F24H 9/0063* (2013.01); *F24H 9/06* (2013.01); *Y10T 137/86799* (2015.04); *Y10T 137/86807* (2015.04); *Y10T 137/86815* (2015.04)

(56) References Cited

U.S. PATENT DOCUMENTS

| | | | | |
|---|---|---|---|---|
| 4,151,811 | A * | 5/1979 | Truhan | A01K 31/18 119/439 |
| 4,796,803 | A | 1/1989 | Kelley | |
| 5,333,835 | A * | 8/1994 | Smith | F24F 13/16 137/554 |
| 2015/0031281 | A1* | 1/2015 | Sello | F24F 13/12 454/284 |

FOREIGN PATENT DOCUMENTS

| | | | |
|---|---|---|---|
| FR | 410415 | A | 5/1910 |
| GB | 2165624 | A | 4/1986 |
| IT | 1233186 | B | 3/1992 |
| WO | 2009153673 | A1 | 12/2009 |
| WO | 2013137803 | A1 | 9/2013 |

* cited by examiner

FLOW CONTROL DEVICES FOR CONVECTOR HEATERS

CROSS-REFERENCE TO RELATED APPLICATIONS

This application is a National Phase Application of PCT International Application No. PCT/IB2015/058708, International Filing Date Nov. 11, 2015 claiming priority to Italian Patent Application No. TO2014A000939 filed Nov. 11, 2014, each of which is hereby incorporated by reference in its entirety.

FIELD OF THE INVENTION

The present invention relates in general to a heating apparatus for convection heating of spaces, in particular industrial and livestock farming spaces, by means of at least one convector heater. More specifically, the present invention relates to a flow control device intended to be used in combination with a convector heater to control the air flow entering the convector heater.

BACKGROUND OF THE INVENTION

It is known to use convector heaters for heating of spaces, in particular industrial and livestock farming spaces. For example, International Patent Application No. WO2009/153673 in the Applicant's name discloses a convector heater comprising a casing, a vertical-axis inlet conduit which is connected to an upper wall of the casing to draw air from the top region of the space where the convector heater is located, a fan which is preferably made as a centrifugal fan and is arranged inside the casing with its axis of rotation directed vertically, and a heater (which may be for example a heat exchanger or a gas burner) for heating the air that is drawn by the fan through the intake conduit. The fan draws air in a substantially vertical (axial) direction from the top end of the intake conduit and expels the air, which may be heated by the heater, in a substantially horizontal (radial) direction. The convector heater is installed so as to be suspended from the ceiling of the space to be heated, for example by means of suspension cables which may be connected to the casing or to the intake conduit.

When such a convector heater (but the same applies to any other kind of convector heater provided with an intake conduit extending vertically towards the ceiling of the space to be heated) is used in a building having a garret, the convector heater is installed in such a manner that the intake conduit draws the air either from the space where the convector heater is installed or from the garret. Once the convector heater with its intake conduit has been installed, it is no more possible to change the space from which the air is drawn, unless the intake conduit is removed and then properly mounted again.

SUMMARY OF THE INVENTION

It is therefore an object of the present invention to allow control of the air flow entering the convector heater so that the air flow can selectively come from the space beneath the ceiling (space to be heated) or from the space above the ceiling (garret).

This and other objects are fully achieved according to the invention by virtue of flow control devices having the features described and claimed herein.

In short, the invention is based on the idea of connecting the top end (free end) of the intake conduit of the convector heater to a flow control device comprising: a casing in the shape of a cylindrical tube having, in a lower portion thereof facing in the mounted condition towards the intake conduit, a plurality of first openings and, in an upper portion thereof facing in the mounted condition towards the opposite side with respect to the intake conduit, a plurality of second openings; a closure member in the shape of a cylindrical tube which is mounted inside the casing so as to be axially slidable between a first position (raised position), in which it leaves the first openings open and closes the second openings, and a second position (lowered position), in which it closes the first openings and leaves the second openings open; and a actuation unit for controlling the axial sliding movement of the closure member relative to the casing between the first and second position. The casing is adapted to be mounted, for example by means of a mounting flange, in a special hole made in the ceiling which separates the space beneath the ceiling (space to be heated) from the space above the ceiling (garret), whereby the first openings are in communication with the space to be heated, while the second openings are in communication with the garret. In this way, when the closure member is in the first position (raised position), the intake conduit of the convector heater is in communication only with the space to be heated through the first openings of the flow control device and therefore the convector heater draws air only from the space to be heated. On the other hand, when the closure member is in the second position (lowered position), the intake conduit of the convector heater is in communication only with the garret through the second openings of the flow control device and therefore the convector heater draws air only from the garret.

Preferably, the actuation unit is able to move the closure member continuously between the first and second position, whereby the flow control device can take a plurality of intermediate configurations in which both the first and second openings are partially open (with different opening levels depending on the axial position of the closure member relative to the casing), and the air can therefore be drawn through the intake conduit both from the space to be heated and from the garret.

Further features and advantages of the invention will be apparent from the following detailed description, given purely by way of non-limiting examples with reference to the attached drawings.

DETAILED DESCRIPTION

In the following description and claims terms such as "vertical" and "horizontal", "upper" and "lower" etc. are to be intended as referring to the operating condition of the flow control device, in which the device is installed on the ceiling of a building with its longitudinal axis directed vertically.

With reference to the drawings, a flow control device according to a preferred embodiment of the present invention is generally indicated 10 and basically comprises a casing 12, having generally the shape of a cylindrical tube (the longitudinal axis of which is indicated x), and a closure member 14, which has also generally the shape of a cylindrical tube and is mounted inside the casing 12 so as to be slidable axially (i.e. in the direction of the longitudinal axis x).

The casing 12 is open at its bottom end, but closed at its top end by means of a cover 16.

Figure 1:
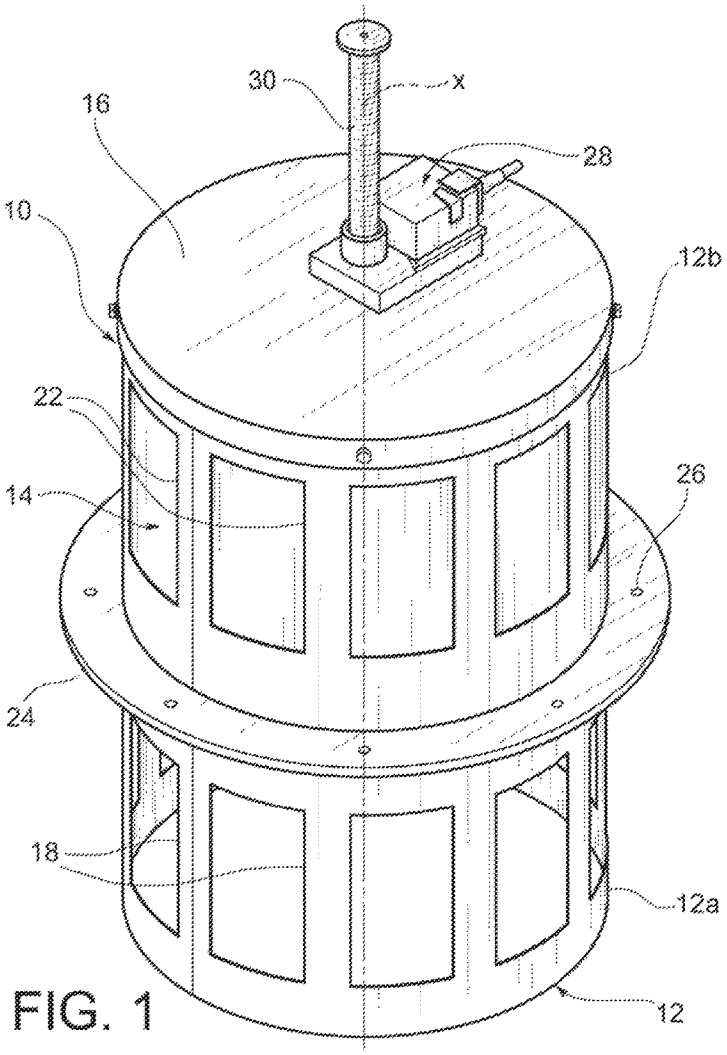
Figure 4:
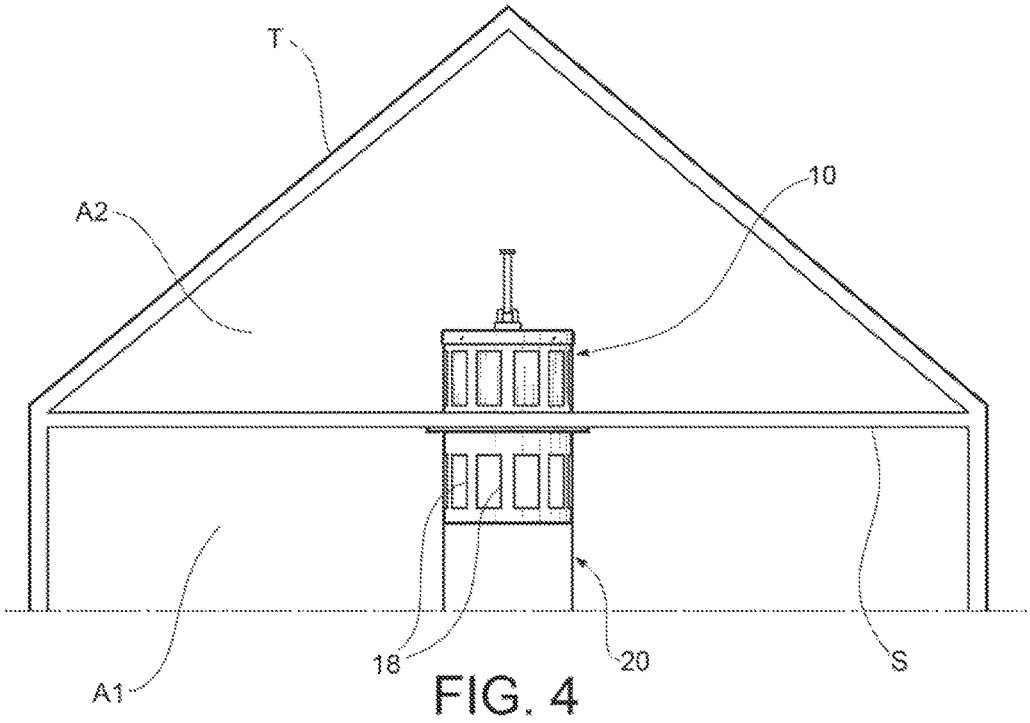
FIGS. 4 and 5 schematically show the mounting of the flow control device of FIGS. 1 and 2 in a building provided with a garret, in the first and second position, respectively.
Figure 5:
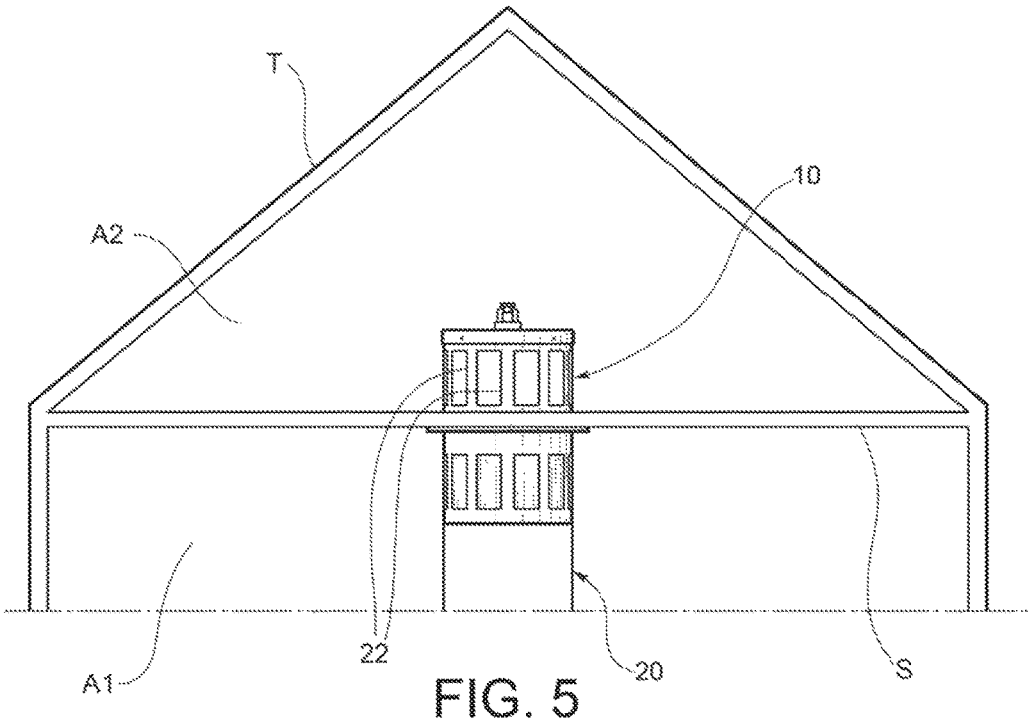

As shown in FIGS. 4 and 5, the flow control device 10 is intended to be installed in a hole (not shown) made in the ceiling S of a building in such a manner that a lower portion 12*a* of the casing 12 projects downwards from the ceiling S and an upper portion 12*b* of the casing 12 projects upwards from the ceiling S. The lower portion 12*a* of the casing 12 has a plurality of first through openings 18, for example of rectangular shape, which are arranged angularly evenly spaced along the entire lateral cylindrical surface of this portion of the casing and, when they are open (FIGS. 1 and 4), put the inside of the casing 12 into communication with a first space A1 beneath the ceiling S, which is the space to be heated and in which at least one convector heater (of which only the intake conduit is shown in FIGS. 4 and 5, where it is indicated 20) is to be installed. The intake conduit 20 of a respective convector heater, as shown in FIGS. 4 and 5, is intended to be connected to the bottom end of the lower portion 12*a* of the casing.

The upper portion 12*b* of the casing 12 has a plurality of second through openings 22, which are also for example of rectangular shape (preferably identical to the corresponding first openings 18 in the lower portion 18*a* of the casing 12) and are arranged angularly evenly spaced along the entire lateral cylindrical surface of this portion of the casing and, when they are open (FIGS. 2 and 5), put the inside of the casing 12 into communication with a second space A2 above the ceiling S (which in the example shown in the drawings is a garret, i.e. that portion of the building which is interposed between the ceiling S and the roof T).

Preferably, between the lower portion 12*a* and the upper portion 12*b* of the casing 12 a mounting flange 24 is provided, which projects radially from the lateral surface of the casing and has a plurality of holes 26 through which screws or similar fixing members (not shown) can be inserted to fix the device 10 to the ceiling S.

Figure 2:
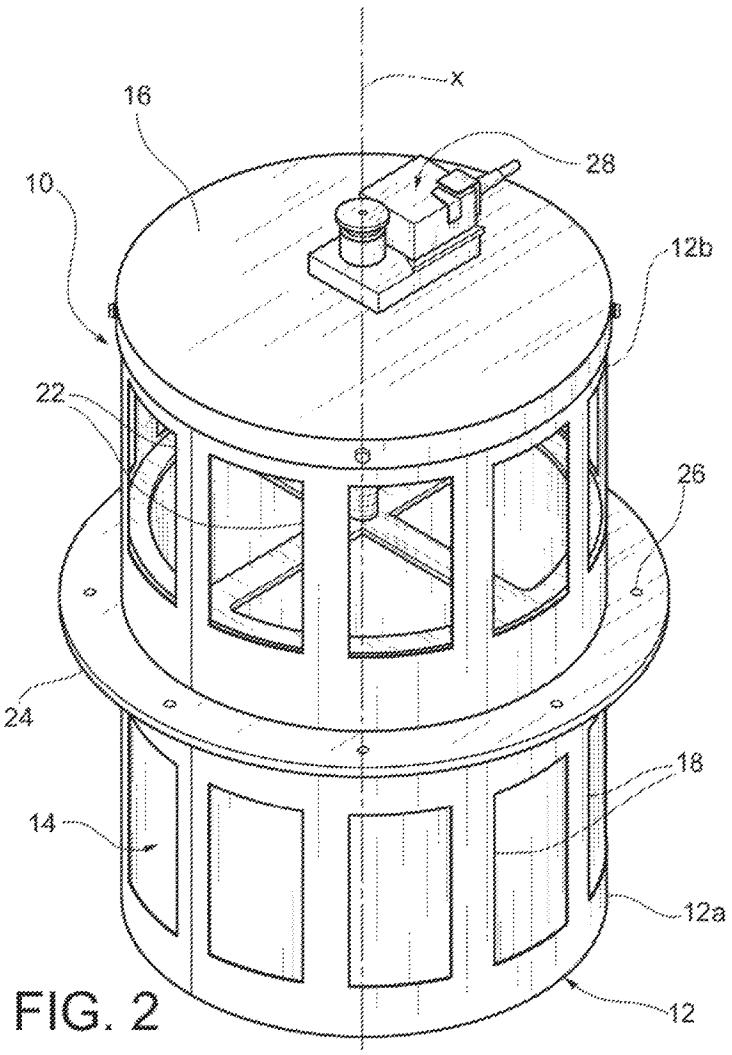
FIGS. 1 and 2 are perspective views showing a flow control device according to a preferred embodiment of the present invention in the first and second position, respectively.

The closure member 14, which as previously mentioned is axially slidable relative to the casing 12, is movable between a first position (raised position), in which his leaves the first openings 18 open and closes the second openings 22 (FIGS. 1 and 3), and a second position (lowered position), in which it closes the first openings 18 and leaves the second openings 22 open (FIG. 2). As shown in FIG. 4, when the closure member 14 is in the first position, the intake conduit 20 of the convector heater is in communication only with the first space A1 (space to be heated) through the first openings 18, and therefore the convector heater draws air from the first space A1 only. On the other hand, when the closure member 14 is in the second position, as shown in FIG. 5, the intake conduit 20 of the convector heater is in communication only with the second space A2 (garret) through the second openings 22, and therefore the convector heater draws air from the second space A2 only.

Figure 3:
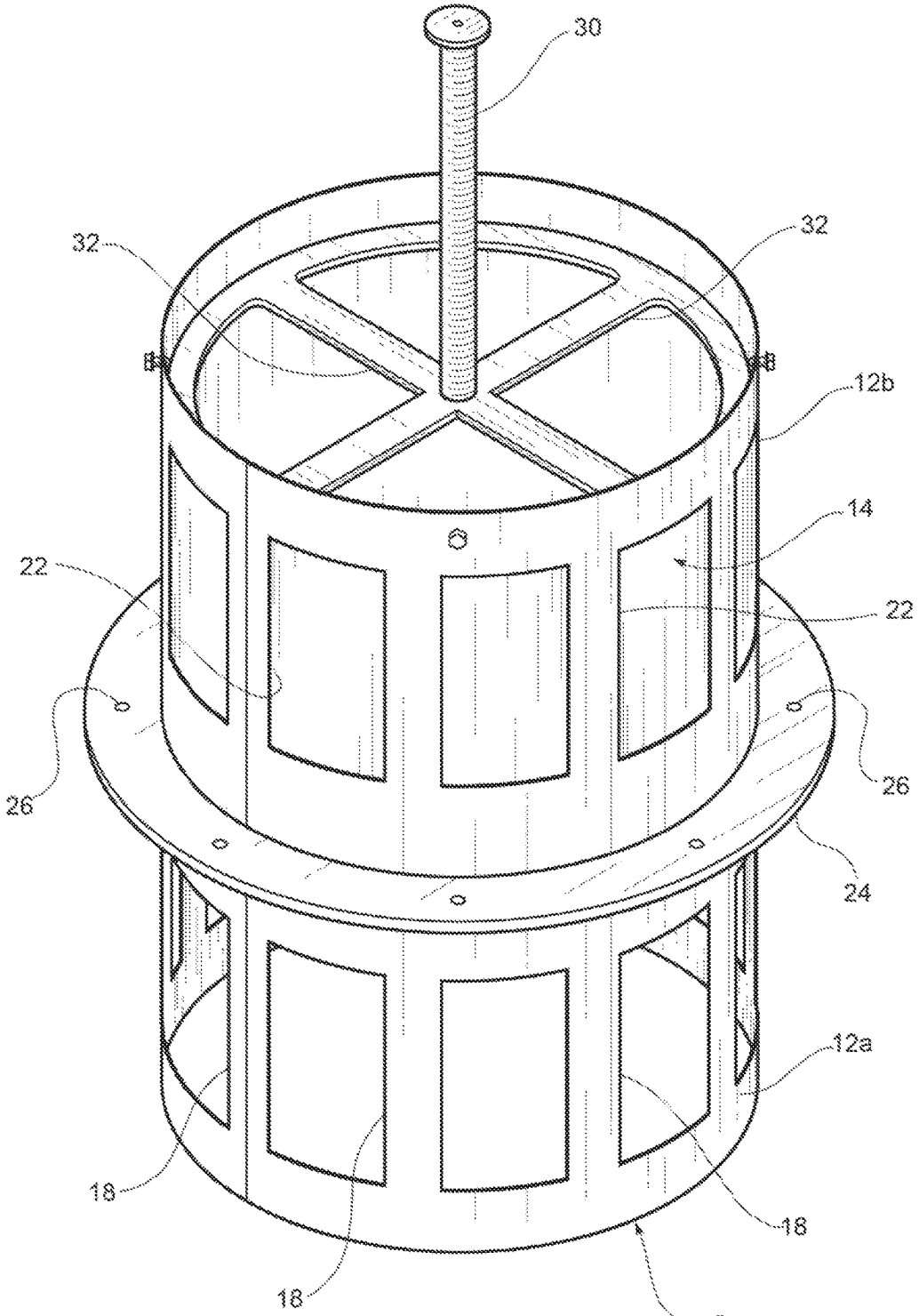
FIG. 3 is a view similar to that of FIG. 1, in which the flow control device is shown without the upper cover.

The flow control device 10 further comprises an actuation unit, generally indicated 28 and illustrated only schematically in the drawings, for controlling the axial sliding movement of the closure member 14 relative to the casing 12 between the first and second position defined above. Preferably, the actuation unit 28 is arranged to move the closure member 14 continuously between the first and second position, whereby the flow control device 10 can take a plurality of intermediate configurations in which both the first openings 18 and the second openings 22 are partially open (with different opening levels depending on the axial position of the closure member 14 relative to the casing 12), and therefore the air can be drawn by the convector heater through the intake conduit 20 both from the first space A1 and from the second space A2. The actuation unit 28 may be of various kinds. Preferably, the actuation unit 28 is an electro-mechanical one and comprises for example an electric motor and a motion transmission mechanism for converting the rotary motion generated by the electric motor into a translational motion of a threaded shaft 30 which, as shown in FIG. 3, is drivingly connected for translation with the closure member 14 by means of a plurality of spikes 32. Preferably, the actuation unit 28 is mounted on the cover 16 of the flow control device 10.

As will be apparent from the above description, a flow control device according to the invention allows to change selectively the point from which the air is drawn by the convector heater through the intake conduit. Depending in fact on the axial position of the closure member relative to the casing, the air is drawn only from the space beneath the ceiling (i.e. from the same space as the one where the convector heater is located) or only from the space above the ceiling (such as for example a garret) or, again, partly from the first space and part1 from the second space. The position of the closure member may be controlled by an electronic control unit depending for example on the temperature (and/or on other parameters) in the first and second space.

Naturally, the principle of the invention remaining unchanged, the embodiments and the constructional details may vary widely from those described and illustrated purely by way of non-limiting examples, without thereby departing from the scope of protection as described and claimed herein.

The invention claimed is:

1. A flow control device to be connected to an intake conduit of a convector heater mounted in a first space (A1) of a building allowing the intake conduit to be placed into communication selectively with the first space (A1) or with a second space (A2) above a ceiling (S) that delimits the first space (A1) from the top, the device comprising:

a casing in the shape of a cylindrical tube having in a first portion thereof, facing in a mounted condition towards the intake conduit, a plurality of first openings and in a second portion thereof, facing in the mounted condition towards to opposite side of the intake conduit, a plurality of second openings, the casing being closed at its end opposite to the one intended to be connected to the intake conduit and being arranged to be mounted onto the ceiling (S) in such a manner that the first and second openings allow placement of the inside of the casing into communication with the first space (A1) and the second space (A2), respectively;

a closure member in the shape of a cylindrical tube which is mounted within the casing and is axially slidable relative to the casing between a first position, in which the closure member leaves the first openings open and closes the second openings, and a second position, in which the closure member closes the first openings and leaves the second openings open; and actuation elements for controlling the axial sliding movement of the closure member relative to the casing between the first and the second position.

2. The device of claim 1, wherein the closure member is able to take a plurality of intermediate positions, between the first and the second position, in which both the first and the second openings are partially open, and wherein said actuation elements are arranged to move the closure member continuously between the first and the second position.

3. The device of claim 1, wherein the casing is provided, in an axially intermediate position between its first and second portion, with a mounting flange for securing the casing to the ceiling (S).

4. A convector heater for convection heating of a first space (A1) of a building, in particular for industrial or livestock farming purposes, comprising an intake conduit and a flow control device of claim 1, the casing of the flow control device being connected, with its first portion, to the intake conduit, in such a manner that depending on the axial position of the closure member relative to the casing of the flow control device the intake conduit is connectable with the first space (A1) and/or with a second space (A2) located above the ceiling (S) that delimits the first space (A1) from the top.

* * * * *